US011254543B2

(12) United States Patent
Suzuki

(10) Patent No.: US 11,254,543 B2
(45) Date of Patent: Feb. 22, 2022

(54) ELEVATOR DOOR PANEL

(71) Applicant: MITSUBISHI ELECTRIC CORPORATION, Chiyoda-ku (JP)

(72) Inventor: Toshiya Suzuki, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 406 days.

(21) Appl. No.: 16/310,927

(22) PCT Filed: Jul. 13, 2016

(86) PCT No.: PCT/JP2016/070726
§ 371 (c)(1),
(2) Date: Dec. 18, 2018

(87) PCT Pub. No.: WO2018/011921
PCT Pub. Date: Jan. 18, 2018

(65) Prior Publication Data
US 2020/0024107 A1 Jan. 23, 2020

(51) Int. Cl.
*B66B 13/30* (2006.01)
*E06B 5/16* (2006.01)

(52) U.S. Cl.
CPC ..... *B66B 13/303* (2013.01); *E06B 5/16* (2013.01)

(58) Field of Classification Search
CPC ..... B66B 13/303; B66B 13/30; E06B 3/70; E06B 5/16
See application file for complete search history.

(56) References Cited

U.S. PATENT DOCUMENTS 5,156,237 A * 10/1992 Hayashi ..... B66B 13/08 187/333
5,293,962 A * 3/1994 Pelvilain ..... E06B 5/16 187/333

(Continued)

FOREIGN PATENT DOCUMENTS

CN 104760875 A * 7/2015 ..... B66B 13/303
EP 0838426 A2 * 4/1998 ..... B66B 13/303

(Continued)

OTHER PUBLICATIONS

Korean Office Action dated Jan. 17, 2020, in Patent Application No. 10-2019-7000147, citing document AO therein, 8 pages (with English translation).

(Continued)

*Primary Examiner* — Michael R Mansen
*Assistant Examiner* — Michelle M Lantrip
(74) *Attorney, Agent, or Firm* — Oblon, McClelland, Maier & Neustadt, L.L.P.

(57) ABSTRACT

An elevator door panel including a front plate, a thermal insulation member, a fixing member, and a longitudinal reinforcement plate, wherein four bent parts are formed by bending upper and lower ends and both side ends of the front plate into a U shape toward the back surface, the longitudinal reinforcement plate is connected to the bent parts by two brim parts on the back surface of the front plate while forming a space between the back surface and the longitudinal reinforcement plate, and the thermal insulation member is provided in the space formed between the longitudinal reinforcement plate and the back surface and fixed by the fixing member.

10 Claims, 6 Drawing Sheets

(56) References Cited

U.S. PATENT DOCUMENTS

| | | | | | |
|---|---|---|---|---|---|
| 5,988,321 | A * | 11/1999 | Kondo | ..... | B66B 13/303 187/333 |
| 6,381,917 | B1 * | 5/2002 | Thielow | ..... | E06B 3/723 52/1 |
| 6,539,673 | B1 * | 4/2003 | Ketonen | ..... | B66B 13/303 52/30 |

FOREIGN PATENT DOCUMENTS

| | | | | | |
|---|---|---|---|---|---|
| EP | 2 042 464 | A1 | | 4/2009 | |
| JP | 61-130583 | U | | 8/1986 | |
| JP | 4-298485 | A | | 10/1992 | |
| JP | 2502182 | B2 | | 5/1996 | |
| JP | 2002211861 | A | * | 7/2002 | |
| JP | 2003327376 | A | * | 11/2003 | |
| JP | 2007153500 | A | * | 6/2007 | |
| JP | 2007211501 | A | * | 8/2007 | ..... B66B 13/303 |
| JP | 2010-143688 | A | | 7/2010 | |
| JP | 2011230932 | A | * | 11/2011 | |
| JP | 5217440 | B2 | | 6/2013 | |
| KR | 20110100818 | A | * | 9/2011 | |
| WO | WO-03016193 | A1 | * | 2/2003 | ..... B66B 13/303 |
| WO | WO 2008/010271 | A1 | | 1/2008 | |
| WO | WO-2013076838 | A1 | * | 5/2013 | ..... B66B 13/303 |
| WO | WO-2014030176 | A1 | * | 2/2014 | ..... B66B 13/303 |

OTHER PUBLICATIONS

International Search Report dated Sep. 20, 2016 in PCT/JP2016/070726 filed on Jul. 13, 2016.

* cited by examiner

ELEVATOR DOOR PANEL

TECHNICAL FIELD

The present invention relates to an elevator door panel.

BACKGROUND ART

It has been suggested to add a thermal insulation panel to an elevator door panel which includes a reinforcement member in order to prevent transfer of heat from the door panel to the hoistway side in case of a fire, for example (see for example PTL 1).

CITATION LIST

Patent Literature

[PTL 1] Japanese Patent No. 2502182

SUMMARY OF INVENTION

Technical Problem

However, in the elevator hall door device disclosed in PTL 1, a thermal insulation panel provided with a decorative board is connected with a door main body through fittings and bolts, and therefore the door has increased thickness and weight. Furthermore, a longitudinal reinforcement member provided inside the door main body is fixed in contact with the front plate of the door main body, and therefore heat from the decorative board is easily transferred to the longitudinal reinforcement member through the fittings and the bolts for the thermal insulation panel. Therefore, the device disclosed in PTL 1 has a thermal insulation sheet inserted between the longitudinal reinforcement member and the back plate of the door main body, and another thermal insulation sheet and a cover are attached around the part of the back plate where the longitudinal reinforcement member is provided, so that many interposed parts serve to prevent heat transfer from the decorative board side to the periphery of the back plate.

The present invention is directed to a solution to the problem, and a door panel having such thermal insulation and rigidity that heat from the front plate is not easily transferred to the reinforcement member can be provided with a reduced number of components.

Solution to Problem

An elevator door panel according to the present invention includes a front plate, a thermal insulation member, and a reinforcement member, the reinforcement member is connected to a peripheral edge part of the front plate while forming a space between a back surface of the front plate and the reinforcement member, and the thermal insulation member is fixed in contact with the back surface of the front plate in the space formed between the reinforcement member and the back surface.

Advantageous Effects of Invention

According to the present invention, an elevator door panel having thermal insulation and rigidity which allows heat from the front plate to be less easily transferred to the reinforcement member can be provided with a reduced number of components.

DESCRIPTION OF EMBODIMENTS

Now, elevator door panels according to preferred embodiments of the present invention will be described with reference to FIGS. 1 to 7.

First Embodiment

Figure 1:
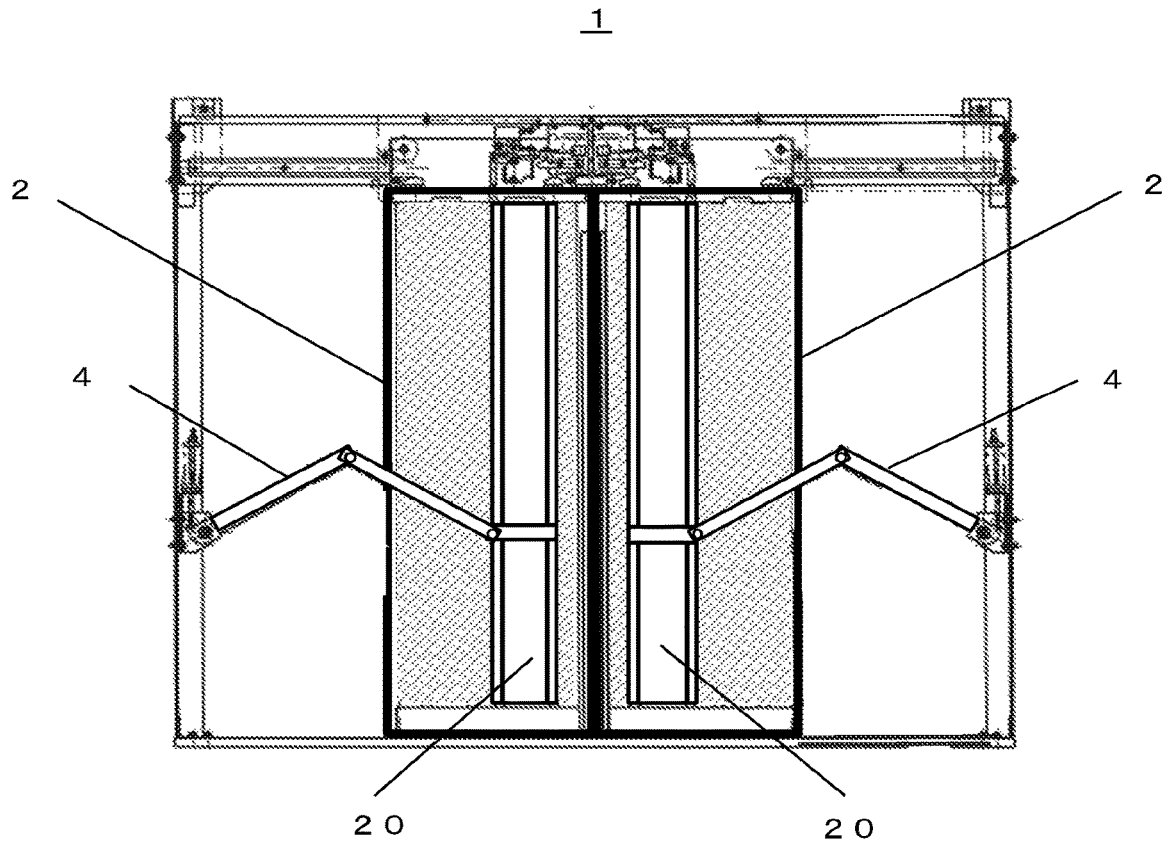
FIG. 1 is a view showing a general structure of an elevator hall door device including a door panel according to a first embodiment of the present invention.
Figure 2:
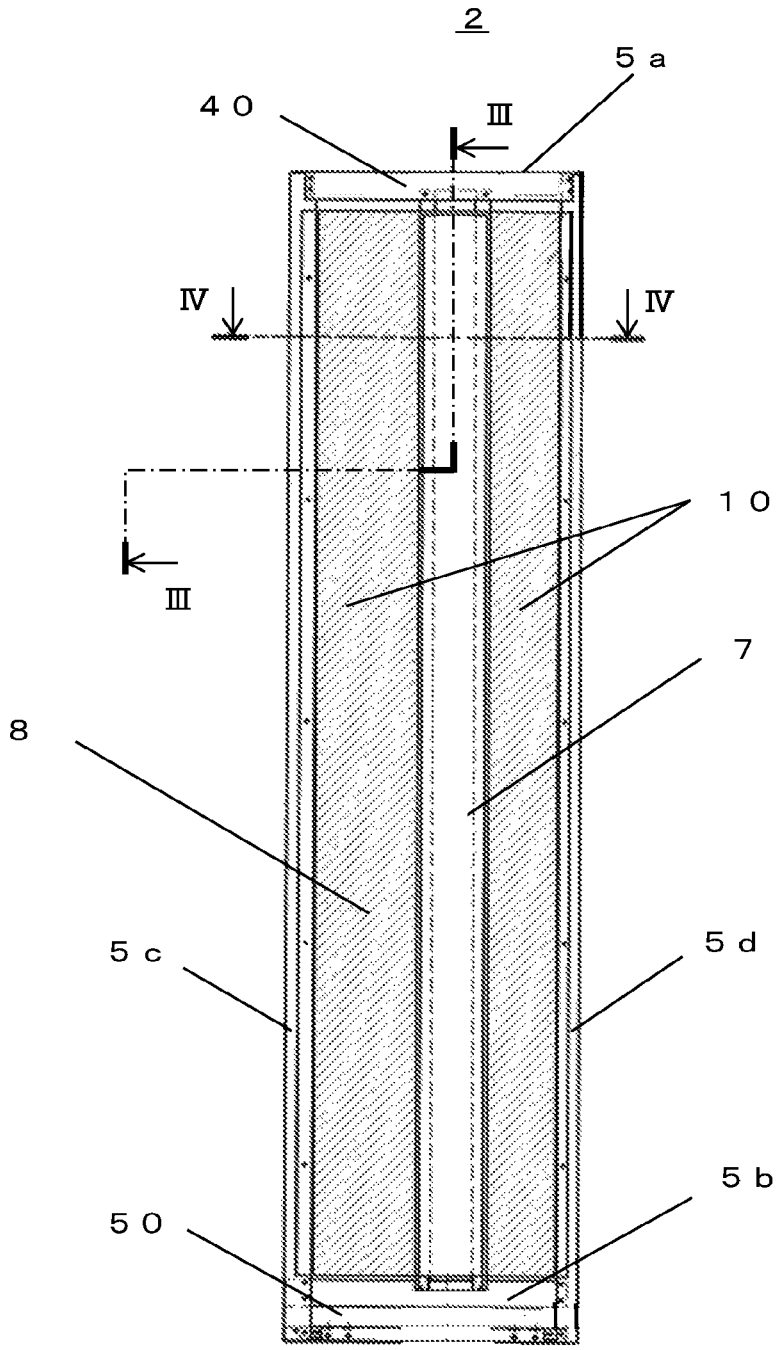
FIG. 2 is a view of the door panel in the hall door device in FIG. 1.

FIG. 1 is a general view of an elevator hall door device including door panels 2 according to a first embodiment of the present invention as the device is viewed from the hoistway side. FIG. 2 is a view of the door panel in the hall door device in FIG. 1, FIG. 3 is a sectional view of the door panel taken along line III-III in FIG. 2, FIG. 4 is a sectional view of the door panel taken along line IV-IV in FIG. 2, and FIG. 5 is a perspective view of a fixing member 15.

As shown in FIG. 1, the door panels 2 are each mounted to the hall door device 1 through a link mechanism 4 having one end side fixed to a longitudinal reinforcement plate 20 provided at the door panel 2. As shown in FIGS. 2 to 4, the door panel 2 includes a front plate 5 provided to have its surface exposed to the hall side, a thermal insulation member 10, the fixing member 15, the longitudinal reinforcement plate 20, and a back plate 7.

Figure 3:
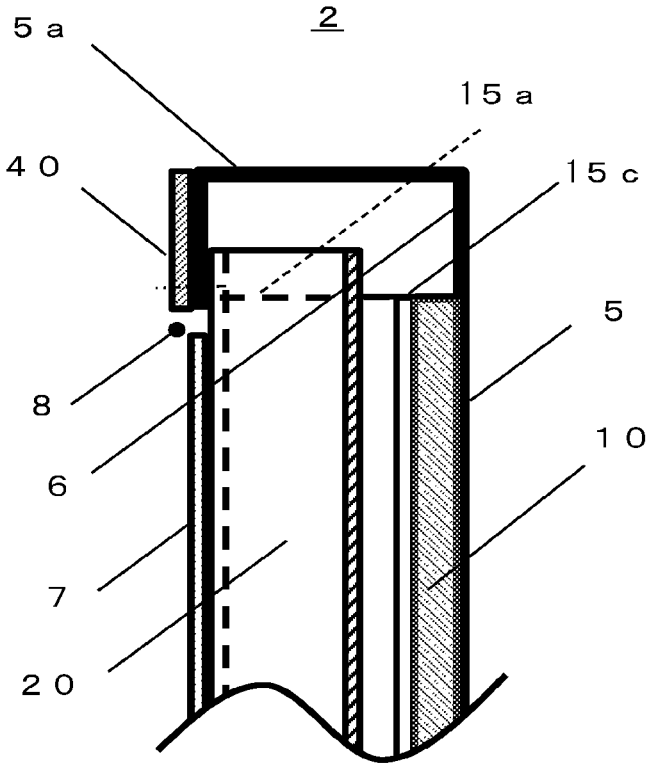
FIG. 3 is a sectional view of the door panel taken along line in FIG. 2.
Figure 4:
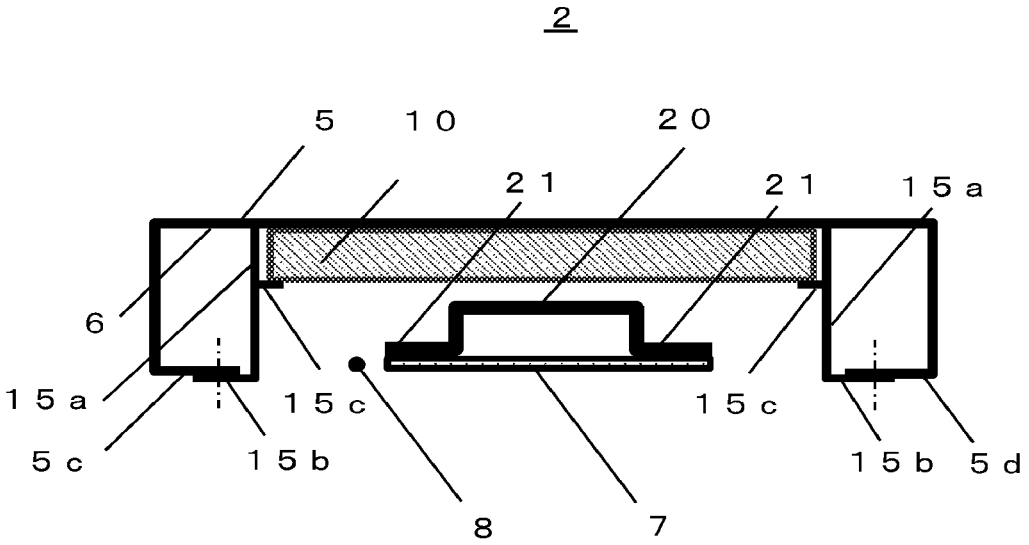
FIG. 4 is a sectional view of the door panel taken along line IV-IV in FIG. 2.

As shown in FIGS. 2 to 4, the front plate 5 has four bent parts 5a to 5d formed by bending upper and lower ends and both side ends thereof into a U shape toward the back surface 6. The front plate 5 is formed into a box shape consisting of these four bent parts 5*a* to 5*d* and the back surface 6, and the ends of the four bent parts 5*a* to 5*d* form an opening 8 of the box shape. A thermal insulation member 10 is inserted through the opening 8 and held in contact with the back surface 6 by the two fixing members 15. Reinforcement plates 40 and 50 are fixed for example using rivets to the upper and lower bent parts 5*a* and 5*b* of the front plate 5 on the side of the back surface 6.

Figure 5:
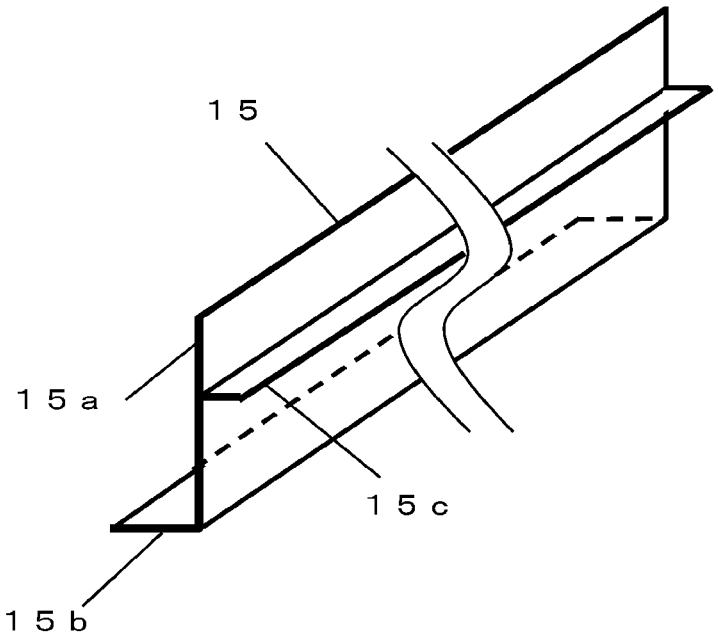
FIG. 5 is a perspective view of a fixing member shown in FIG. 4.

As shown in the sectional view in FIG. 4 and the perspective view in FIG. 5, the two fixing members 15 each have first and second plate-shaped parts 15*a* and 15*b* arranged in an L shape in the sectional view in FIG. 4. A third plate-shaped part 15*c* has its one end side fixed for example by welding in a position a prescribed distance apart from the end of the first plate-shaped part 15*a* to the center side and the other end extending in the opposite direction to the extending direction of the second plate-shaped part 15*b* and in the direction perpendicular to the first plate-shaped part 15*a*.

As shown in FIG. 4, the two fixing members 15 each restrict the movement of the thermal insulation member 10 in the horizontal direction by the first plate-shaped part 15*a*.

The third plate-shaped part 15*c* holds the thermal insulation member 10 such that the thermal insulation member 10 is in contact with the back surface 6 of the front plate 5. The two fixing members 15 are fixed to the bent parts 5*c* and 5*d* formed by the both side ends of the front plate 5 by the second plate-shaped parts 15*b* for example using rivets.

As shown in FIG. 1, the longitudinal reinforcement plate 20 is provided in the vicinity of the center of the door panel 2 to increase the rigidity of the door panel 2 and also forma support for the link mechanism 4 which moves the door panel 2. As shown in FIG. 4, the longitudinal reinforcement plate 20 provided at the door panel 2 has a horizontal cross section in a hat shape having a raised part and two brim parts 21.

As shown in FIGS. 2 to 4, the longitudinal reinforcement plate 20 is connected to the bent parts 5*a* and 5*b* of the front plate 5 by the two brim parts 21 for example using rivets on the back surface 6 of the front plate 5 while forming a space between the reinforcement plate and the back surface 6. The thermal insulation member 10 is stored in the space formed between the longitudinal reinforcement plate 20 and the back surface 6.

As shown in FIGS. 2 to 4, the back plate 7 is attached to a surface of the brim part 21 on the opposite side to the front plate 5, and the support for the link mechanism 4 shown in FIG. 1 is provided at the back plate 7.

In the elevator door panel 2 as described above, the four bent parts 5*a* to 5*d* are formed by bending the upper and lower ends and the both side ends of the front plate 5 into a U shape toward the back surface 6 of the front plate 5, and the thermal insulation member 10 is inserted through the opening 8 formed by the ends of the four bent parts 5*a* to 5*d* and provided on the back surface 6. The two fixing members 15 hold the thermal insulation member 10 such that the thermal insulation member 10 is in contact with the back surface 6 of the front plate 5 on the back surface 6 and are fixed to the two bent parts 5*c* and 5*d* formed by the both side ends of the front plate 5. The longitudinal reinforcement plate 20 provided at the door panel 2 is formed to have a horizontal cross section in a hat shape having the raised part and the two brim parts 21. Then, the longitudinal reinforcement plate 20 is connected to the bent parts 5*a* and 5*b* by the two brim parts 21 on the back surface 6 of the front plate 5 while the space is formed between the reinforcement plate and the back surface 6. Then, the thermal insulation member 10 is stored in the space formed between the longitudinal reinforcement plate 20 and the back surface 6.

In this way, heat from the front plate 5 is not easily transferred to the longitudinal reinforcement plate 20 without interposing a thermal insulation sheet or a cover, so that a problem in opening/closing the hall doors, which would otherwise be caused by thermal deformation of the link mechanisms 4 attached to the longitudinal reinforcement plates 20, can be prevented.

Note that according to the first embodiment, the longitudinal reinforcement plate 20 is fixed to the bent parts 5*a* and 5*b* of the front plate 5 by the two brim parts 21, but the arrangement is not limited to this. For example, the two brim parts 21 may be fixed to the upper and lower reinforcement plates 40 and 50 attached above and under the front plate 5 on the side of the back surface 6. According to the first embodiment, the width of the back plate 7 is substantially equal to the width of the longitudinal reinforcement plate 20, but the width may be equal to the width of the door panel 2. In addition, the support for the link mechanism 4 maybe provided at the longitudinal reinforcement plate 20 without providing the back plate 7.

Second Embodiment

Figure 6:
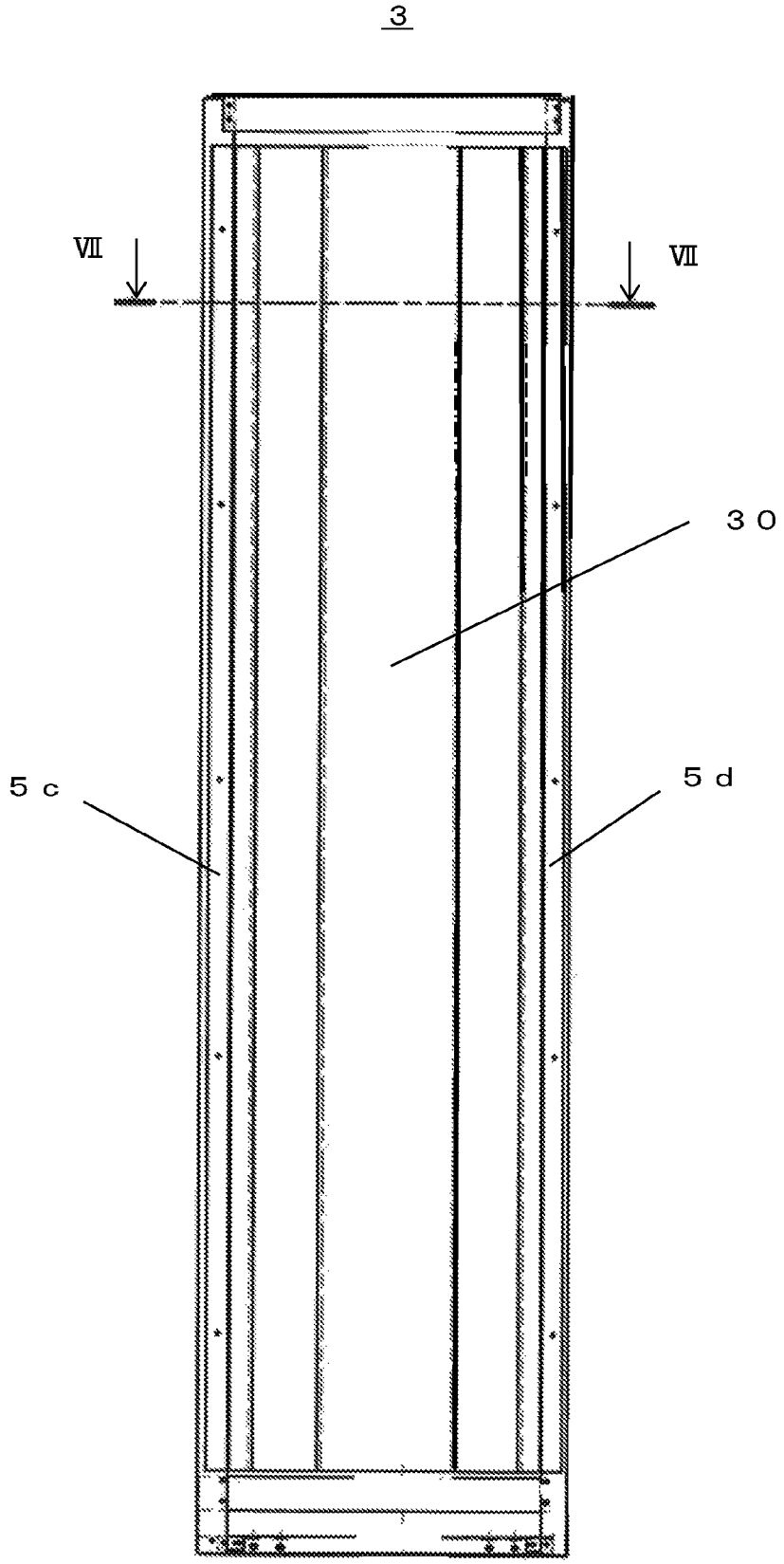
FIG. 6 is a view of a door panel according to a second embodiment of the present invention.
Figure 7:
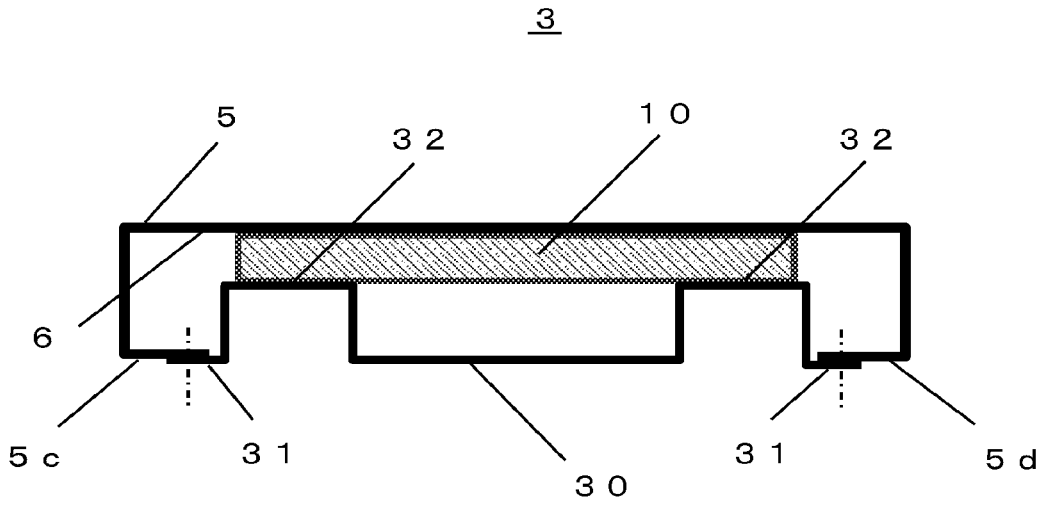
FIG. 7 is a sectional view of the door panel taken along line VII-VII in FIG. 6.

FIG. 6 is a view of a door panel 3 according to a second embodiment of the present invention, and FIG. 7 is a sectional view of the door panel 3 taken along line VII-VII in FIG. 6. As shown in FIGS. 6 and 7, the door panel 3 includes a front plate 5, a thermal insulation member 10, and a longitudinal reinforcement plate 30, and the door panel 3 does not include the fixing members 15 and the back plate 7 as shown in FIG. 7. The structure of the bent parts 5*a* to 5*d* of the front plate 5 is similar to the first embodiment.

The longitudinal reinforcement plate 30 is formed to have a horizontal cross section in a shape having a plurality of raised parts and two brim parts 31. The longitudinal reinforcement plate 30 is connected to the bent parts 5*c* and 5*d* of the front plate 5 by the two brim parts 31 for example using rivets on the back surface 6 of the front plate 5 while forming a space between the back surface 6 of the front plate 5 and the reinforcement plate. The thermal insulation member 10 is inserted in the space formed between the longitudinal reinforcement plate 30 and the back surface 6. The thermal insulation member 10 is pressed by the tops 32 of the plurality of raised parts provided at the longitudinal reinforcement plate 30 and held in contact with the back surface 6 of the front plate 5.

In the elevator door panel 3, the longitudinal reinforcement plate 30 is fixed to the bent parts 5*c* and 5*d* on the back surface 6 of the front plate 5 while forming a space between the back surface 6 and the reinforcement plate. The thermal insulation member 10 is stored in the space, and the thermal insulation member 10 is pressed and held by the tops 32 of the plurality of raised parts provided at the longitudinal reinforcement plate 30. In this way, heat from the front plate 5 is not easily transmitted to the longitudinal reinforcement plate 30 without interposing a thermal insulation sheet or a cover. Therefore, a problem in opening/closing the hall doors, which would otherwise be caused by thermal deformation of the link mechanism 4 attached to the longitudinal reinforcement plate 30, can be prevented. In addition, since the thermal insulation member 10 is held without using the fixing members 15, the door panels 3 may be provided with desired thermal insulation and rigidity with a reduced number of parts.

Note that in the sectional view in FIG. 7, the raised parts of the longitudinal reinforcement plate 30 are shaped by straight lines, but the raised parts maybe formed in other shapes. For example, the raised parts maybe formed to have a semi-circular shape or the entire longitudinal reinforcement plate 30 excluding the brim parts 31 may be formed in a corrugated shape. In FIG. 6, the longitudinal reinforcement plate 30 has a height equal to the length from the upper end bent part 5*a* to the lower end bent part 5*b* of the door panel 3, but the plate may have a different height. For example, the height may be reduced, so that the longitudinal reinforcement plate maybe provided in plurality to press the upper, lower, and middle parts of the thermal insulation member 10. According to the second embodiment, the two brim parts 31 are fixed to the two bent parts 5*c* and 5*d* formed by both side ends of the front plate 5, but the arrangement is not limited to this. For example, the two brim parts 31 may be fixed to the two bent parts 5*a* and 5*b* formed by upper and lower ends of the front plate 5 or to the reinforcement plates 40 and 50 provided above and under the front plate 5 on the side of the back surface 6.

REFERENCE SIGNS LIST

1 Hall door device
2 to 3 Door panel

4 Link mechanism
Front plate
5*a* to 5*d* Bent part
6 Back surface
7 Back plate
8 Opening
10 Thermal insulation member
15 Fixing member
15*a* First plate-shaped part
15*b* Second plate-shaped part
15*c* Third plate-shaped part
20, 30 Longitudinal reinforcement plate (reinforcement member)
21, 31 Brim part
32 Top

The invention claimed is:

1. An elevator door panel, comprising:
a front plate;
a thermal insulation member; and
a reinforcement member, wherein
the reinforcement member is connected to upper and lower peripheral edge parts of the front plate while maintaining a space between a hack surface of the front plate and the reinforcement member,
the thermal insulation member is fixed in contact with the back surface such that the thermal insulation member is positioned in the space while leaving a second smaller space between the reinforcement member and the thermal insulation member,
the reinforcement member is formed to have a horizontal cross section in a shape having a raised part and a plurality of brim parts, and
the reinforcement member is fixed to the upper and lower peripheral edge parts of the front plate by the plurality of brim parts.

2. The elevator door panel of claim 1, wherein
the upper and lower peripheral edge parts of the front plate have a plurality of bent parts formed by bending ends thereof toward the back surface of the front plate,
the thermal insulation member is provided on an inner side of the plurality of bent parts on the back surface of the front plate, and
the reinforcement member is connected to the plurality of bent parts.

3. The elevator door panel of claim 2, comprising a fixing member to which the thermal insulation member is attached, wherein
the fixing member includes, on the back surface of the front plate, a part which holds the thermal insulation member such that the thermal insulation member is in contact with the back surface, and
a part fixed to each of the bent parts.

4. The elevator door panel of claim 3, wherein
the fixing member includes
first and second plate-shaped parts arranged in an L shape in a horizontal cross section of the fixing member in a state of being fixed to the front plate, and
a third plate-shaped part having one end side fixed in a position a prescribed distance apart from an end of the first plate-shaped part to a center side in the cross section and the other end side extending in a direction opposite to an extending direction of the second plate-shaped part and perpendicular to the first plate-shaped part in the cross section, and
the fixing member holds an end of the thermal insulation member by the first and third plate-shaped parts and is fixed to the front plate by the second plate-shaped part.

5. The elevator door panel of claim 4, comprising the fixing member in plurality, wherein
one of a plurality of fixing members holds one end side of the thermal insulation member, and
another of the plurality of fixing members holds the other end side of the thermal insulation member.

6. The elevator door panel of claim 3, comprising the fixing member in plurality, wherein
one of a plurality of fixing members holds one end side of the thermal insulation member, and
another of the plurality of fixing members holds the other end side of the thermal insulation member.

7. The elevator door panel of claim 1, comprising a fixing member to which the thermal insulation member is attached, wherein
the fixing member includes, on the back surface of the front plate, a part which holds the thermal insulation member such that the thermal insulation member is in contact with the back surface, and
a part fixed to the upper and lower peripheral edge parts of the front plate.

8. The elevator door panel of claim 7, wherein
the fixing member includes
first and second plate-shaped parts arranged in an L shape in a horizontal cross section of the fixing member in a state of being fixed to the front plate, and
a third plate-shaped part having one end side fixed a position a prescribed distance apart from an end of the first plate-shaped part to a center side in the cross section and the other end side extending in a direction opposite to an extending direction of the second plate-shaped part and perpendicular to the first plate-shaped part in the cross section, and
the fixing member holds an end of the thermal insulation member by the first and third plate-shaped parts and is fixed to the front plate by the second plate-shaped part.

9. The elevator door panel of claim 8, comprising the fixing member in plurality, wherein
one of a plurality of fixing members holds one end side of the thermal insulation member, and
another of the plurality of fixing members holds the other end side of the thermal insulation member.

10. The elevator door panel of claim 7, comprising the fixing member in plurality, wherein
one of a plurality of fixing members holds one end side of the thermal insulation member, and
another of the plurality of fixing members holds the other end side of the thermal insulation member.

* * * * *